US006405935B2

(12) United States Patent
Dantes et al.

(10) Patent No.: US 6,405,935 B2
(45) **Date of Patent: *Jun. 18, 2002**

(54) FUEL INJECTION VALVE AND A METHOD FOR INSTALLING A FUEL INJECTION VALVE

(75) Inventors: Günter Dantes, Eberdingen; Detlef Nowak, Untergruppenbach; Jörg Heyse, Markgröningen, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/445,520

(22) PCT Filed: Jan. 29, 1999

(86) PCT No.: PCT/DE99/00229

§ 371 (c)(1),
(2), (4) Date: Dec. 7, 1999

(87) PCT Pub. No.: WO99/53190

PCT Pub. Date: Oct. 21, 1999

(30) Foreign Application Priority Data

Apr. 8, 1998 (DE) ..... 198 15 780

(51) Int. Cl.[7] ..... F02D 1/06; B05B 1/34

(52) U.S. Cl. ..... 239/5; 239/494; 239/496; 239/585.1; 239/585.5; 239/596; 239/600

(58) Field of Search ..... 239/1, 5, 463, 239/468, 491, 494, 496, 533.11, 533.12, 585.1, 585.4, 585.5, 596, 600

(56) References Cited

U.S. PATENT DOCUMENTS 4,254,915 A * 3/1981 Muller ..... 239/533.12
5,044,562 A * 9/1991 Rogers et al. ..... 239/596 X
5,383,597 A * 1/1995 Sooriakumar et al. ..... 239/5
5,437,413 A * 8/1995 Shen et al. ..... 239/585.4 X
5,484,108 A * 1/1996 Nally ..... 239/585.4 X
5,570,841 A * 11/1996 Pace et al. ..... 239/496 X
5,685,491 A * 11/1997 Marks et al. ..... 239/596 X
5,716,009 A * 2/1998 Ogihara et al. ..... 239/596 X
5,899,390 A * 5/1999 Arndt et al. ..... 239/596 X
5,996,910 A * 12/1999 Takeda et al. ..... 239/585.1
6,050,507 A * 4/2000 Holzgrefe et al. ..... 239/596 X
6,089,473 A * 7/2000 Keim ..... 239/533.12

FOREIGN PATENT DOCUMENTS

| | | |
|---|---|---|
| DE | 39 43 005 | 7/1990 |
| DE | 196 07 288 | 10/1996 |
| EP | 0 481 608 | 4/1992 |
| EP | 0 611 886 | 8/1994 |
| EP | 0 616 663 | 9/1994 |
| WO | WO 96 11335 | 4/1996 |

OTHER PUBLICATIONS

Patent Abstract of Japan, vol. 098. No. 005, Apr. 30, 1998 & JP 10 018943 (Aisan Ind Co. Ltd.), Jan. 20, 1998*.

* cited by examiner

*Primary Examiner*—Steven J. Ganey
(74) *Attorney, Agent, or Firm*—Kenyon & Kenyon

(57) ABSTRACT

Fuel injection valve is described which possesses a multi-layer swirl valve downstream from a valve seat shaped onto a valve seat element, at least these two components being installed from the inflow direction into a passthrough opening of a valve seat support. The valve seat support has a lower base region that provides for a reduction in the cross section of the passthrough opening downstream from the valve seat. The fuel injection valve is suitable in particular for direct injection of fuel into a combustion chamber of a mixture-compressing, spark-ignited internal combustion engine.

26 Claims, 3 Drawing Sheets

FUEL INJECTION VALVE AND A METHOD FOR INSTALLING A FUEL INJECTION VALVE

FIELD OF THE INVENTION

The present invention is based on a fuel injection valve and a method for assembling a fuel injection valve.

BACKGROUND INFORMATION

German Patent No. 39 43 005 describes an electromagnetically actuable fuel injection valve in which several disk-shaped elements are arranged in the seat region. Upon excitation of the magnetic circuit, a flat valve plate functioning as a flat armature is lifted away from a valve seat plate located opposite and coacting with it; together they form a plate valve element. Arranged upstream from the valve seat plate is a swirl element that imparts a circular rotary motion to the fuel flowing toward the valve seat. A stop plate limits the axial travel of the valve plate on the side opposite the valve seat plate. The valve plate is surrounded by the swirl element with a large clearance; the swirl element thus provides a certain guidance for the valve plate. Recessed in the swirl element on its lower end face are several tangentially extending grooves which proceed from the outer periphery and extend into a central swirl chamber. Because the swirl element rests with its lower end face on the valve seat plate, the grooves exist as swirl channels.

WO 96/11335 describes a fuel injection valve on whose downstream end is arranged a multiple-disk atomization extension with a swirl preparation function. This atomization extension is provided downstream from a disk-shaped guide element built into a valve seat support, and from a valve seat also on the valve seat support; an additional support element holds the atomization extension in a defined position. The atomization extension is embodied with two disks or four disks, the individual disks being manufactured from stainless steel or silicon. Conventional machining methods, such as electrodischarge machining, punching, or etching, are correspondingly used in the manufacture of the opening geometries in the disks. Each individual disk of the atomization extension is fabricated separately, after which, in accordance with the desired number of disks, all the disks of the same size are stacked onto one another to form the complete atomization extension. Assembly of the atomization extension is accomplished from the downstream, spray-discharge end of the valve. From this end, the guide element, valve seat element, atomization extension, and support element are introduced into the stepped passthrough opening of the valve seat support up to a stop. This entire component complex is retained in the valve seat support by the fact that an end region of the valve seat support is subsequently folded over by crimping or bending.

European Patent No. 0 616 663 describes a fuel injection valve in which a valve seat element can be inserted, in the spray-discharge direction, into an extension body that can be screwed onto the valve housing. The valve seat element rests on a shoulder of the extension body, and is thereby at least partially supported from below by the extension body. The extension body with the valve seat element in place is, however, screwed onto the valve housing against the spray-discharge direction until the valve seat element comes into contact against a swirl insert arranged upstream from it.

German Patent Application No. 196 07 288 describes in the so-called multilayer electroplating process for manufacturing orifice disks that are suitable, in particular, for use in fuel injection valves. This principle for manufacturing disks by multiple electroplating deposition of variously structured metals onto one another, resulting in an integral disk, is expressly incorporated herein by reference. Microelectroplating metal deposition in several planes, plies, or layers is also used to manufacture the atomization disks used here and incorporated according to the present invention.

SUMMARY

The fuel injection valve according to the present invention has the advantage of yielding a very high atomization quality in a fuel that is to be sprayed out, as well as spray shaping that is configurable in highly variable fashion and adapted to the respective requirements (e.g. installation conditions, engine configurations, cylinder shapes, spark plug position). One of the consequences of using atomizer disks that are very easy to place in the fuel injection valve is that the exhaust emissions of an internal combustion engine equipped with corresponding fuel injection valves are reduced, and also that a decrease in fuel consumption is attained.

Particularly advantageously, the atomizer disk is manufactured by multilayer electroplating. Because of their metallic configuration, the atomizer disks are highly resistant to breakage and easily assembled. The use of multilayer electroplating allows a great deal of design freedom, since the contours of the opening regions (inlet regions, swirl channels, swirl chamber, outlet opening) in the atomizer disk can be selected without restriction. This flexible conformation is very advantageous especially by comparison with silicon disks, in which the contours achievable (truncated pyramids) are strictly defined based on the crystal axes.

Metal deposition offers a very wide selection of materials, especially by comparison with the manufacture of silicon disks. A large variety of metals, with their differing magnetic properties and hardnesses, can be utilized in the microelectroplating method used to manufacture the atomizer disks.

It is advantageous to embody the atomizer disk in the form of a swirl disk. It is particularly advantageous to construct the swirl disk, comprising three layers, by performing three electroplating steps for metal deposition. The swirl generation layer is constituted by one or more material regions that, because of their contouring and their geometrical position with respect to one another, yield the contours of the swirl chamber and the swirl channels. With the electroplating process, the individual layers are built up onto one another without joins or seams, so that they represent continuously homogeneous material. To that extent, the term "layers" is to be taken as an aid to understanding.

Advantageously, two, three, four, or six swirl channels are provided in the swirl disk. The material regions can possess very different shapes corresponding to the desired contouring of the swirl channels, e.g., can be strut-like or helical.

The method according to the present invention for assembling a fuel injection valve, has the advantage of particularly simple attachment of an atomizer disk to the downstream valve end. An atomizer disk can be securely mounted while dispensing with weld joins. The outer contour of a valve seat support partially forming a valve housing can be configured in particularly simple and compact fashion with a base region used to receive valve components.

DETAILED DESCRIPTION

Figure 1:
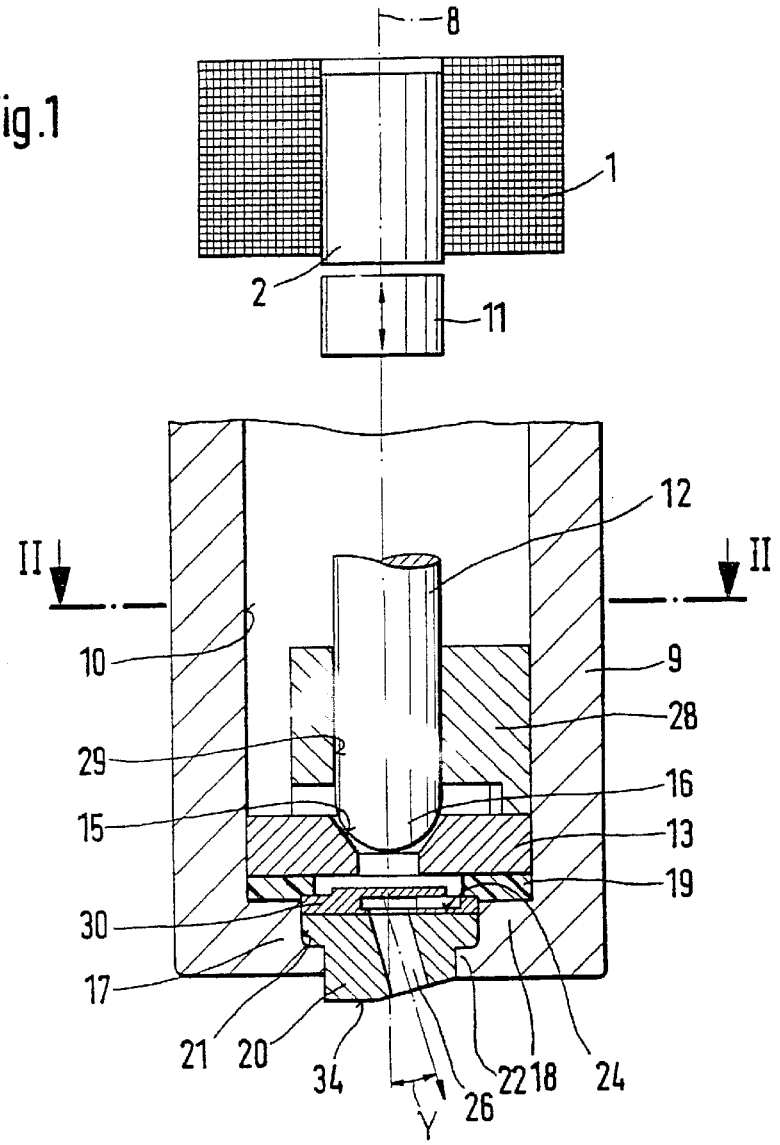
FIG. 1 shows a partial view of a fuel injection valve in section with an atomizer disk at the downstream valve end, according to an example embodiment of the present invention.

The electromagnetically actuable valve depicted in exemplary and simplified form in FIG. 1, in the form of an injection valve for fuel injection systems of mixture-compressing, spark-ignited internal combustion engines, has a tubular and largely hollow-cylindrical core 2 that is at least partially surrounded by a magnet coil 1 and serves as the inner pole of a magnetic circuit. The fuel injection valve is suitable particularly as a high-pressure injection valve for direct injection of fuel into a combustion chamber of an internal combustion engine.

The valve extends along a longitudinal valve axis 8. A valve housing is constituted at least partially by an elongated, stepped valve seat support 9, in whose inner passthrough opening 10 is provided an axially movable valve part. This valve part comprises at least an armature 11 and a rod-shaped valve needle 12 that is surrounded by valve seat support 9. Valve seat support 9 is part of a valve housing and is configured concentrically with longitudinal valve axis 8. The valve part can also, for example, be configured in the form of a flat disk with an integrated armature.

At its lower end, passthrough opening 10 is embodied with at least one, but advantageously with multiple steps, such that when viewed in the flow direction, the cross section of passthrough opening 10 becomes smaller with each step. At least one e.g., disk-shaped valve seat element 13 and one atomizer disk 30 are arranged in passthrough opening 10, atomizer disk 30 coming after valve seat element 13 in the downstream direction. Valve seat element 13 has a valve seat surface 15 that tapers downstream in the shape of a truncated cone. Valve needle 12 possesses at its downstream end a valve closure segment 16. This valve closure segment 16, rounded off e.g., in semi-spherical shape, coacts in a conventional fashion with valve seat surface 15 in order to open and close the valve.

Actuation of the injection valve is accomplished in a conventional fashion, for example, electromagnetically. The electromagnetic circuit shown, with magnet coil 1, core 2, and armature 11, serves to move valve needle 12 axially, and thus to open the injection valve against the spring force of a return spring (not shown) and to close it. Armature 11 is joined by, for example, a weld join to the end of valve needle 12 facing away from valve closure segment 16, and is aligned on core 2.

A different energizable actuator, for example a piezostack, can also be used in a comparable fuel injection valve instead of the electromagnetic circuit; or actuation of the axially movable valve part can be accomplished by hydraulic pressure or servo pressure.

The linear stroke of valve needle 12 is defined, among other criteria, by valve seat surface 15. One end position of valve needle 12, when magnet coil 1 is not energized, is defined by contact of valve closure segment 16 against valve seat surface 15, while the other end position of valve needle 12, when magnet coil 1 is energized, results from contact of armature 11 against the downstream end face of core 2. The surfaces of the components in the latter contact region are, for example, chrome-plated.

Because of its geometry and its specific function, atomizer disk 30 that is installed according to the present invention is referred to in the exemplary embodiments as swirl disk 30. Swirl disk 30 is manufactured, for example, by multilayer electroplating, and comprises three metal layers deposited onto one another.

One basic variant (not shown) provides for only valve seat element 13 and swirl disk 30 to be incorporated into passthrough opening 10 in the downstream valve end. In this context, both components (13 and 30) are configured with an outside diameter largely the same as the inside diameter of passthrough opening 10. Swirl disk 30 rests on a lower shoulder 18 of valve seat support 9, which results in a decrease in the cross section of passthrough opening 10. Shoulder 18 is part of a base region 17 of valve seat support 9 that extends at least partially transversely to longitudinal valve axis 9. As a characteristic of the present invention of this variant (not depicted) and all exemplary embodiments hereinafter, it may be noted that all the internal fixtures on the downstream valve end are introduced into and assembled in passthrough opening 10 from the inflow direction of the valve. The configuration of base region 17, which forms at least one shoulder 18, and the support and assembly aid thereby created, rule out any installation from the spray-discharge end of the valve.

In the case of the exemplary embodiment shown in FIG. 1, further internal fixtures which guarantee particularly secure and sealed installation of swirl disk 30 are provided in passthrough opening 10 in addition to the components already described. In this instance, a disk-shaped sealing element 19 rests on shoulder 18 below valve seat element 13. Sealing element 19 is configured with the same outside diameter as the inside diameter of passthrough opening 10. Aluminum, copper, nickel, or Teflon® are particularly suitable materials for sealing element 19. In this segment 21, passthrough opening 10, whose opening width becomes smaller downstream from shoulder 18, receives both swirl disk 30 and a support element 20. Support element 20 is, for example, of stepped configuration on its outer contour and sits with a corresponding step in defined fashion on a further shoulder 22 of base region 17 in lower segment 21 of passthrough opening 10. In lower segment 21 of passthrough opening 10, support element 20 constitutes a dimensionally accurate internal fixture.

Swirl disk 30 rests on upper end face 24 of support element 20, swirl disk 30 being partially fitted into lower segment 21 of passthrough opening 10. Sealing element 19 presses, from the side facing away from support element 20, at least on the outer rim region of swirl disk 30. Configured in support element 20 is an outlet opening 26 that is introduced, for example, by punching or electrodischarge machining and through which the fuel, with a swirl now imparted to it, leaves the fuel injection valve.

For direct gasoline injection, injection valves directly on the combustion chamber, which discharge a spray inclined obliquely with respect to longitudinal valve axis 8, are advantageous, e.g., because of certain installation conditions. What is to be produced in this context is a hollow-conical spray with maximum rotational symmetry and with a swirl imparted it, and with a uniform distribution over the circumference of the hollow cone.

One possible example configuration for producing an inclined spray is depicted in FIG. 1, in which outlet opening 26 in support element 20 is introduced in a manner inclined obliquely with respect to longitudinal valve axis 8. Outlet opening 26 begins, for example, centeredly at upper end face 24 and ends eccentrically at lower end face 34 of support element 20, the inclination of outlet opening 26 determining the spray angle of the overall spray with respect to longitudinal valve axis 8. The spray orientation is labeled with an arrow and γ, γ denoting the angle of the spray with respect to longitudinal valve axis 8.

Swirl disk 30 is an integral component, since the individual layers are deposited by electroplating directly onto one another (multilayer electroplating), rather than being fitted together only later. The successive layer joins immovably, by galvanic adhesion, to the respective layer below. In the present case, swirl disk 30 is constituted from three planes, plies, or layers deposited onto one another by electroplating, which thus, in the installed state, directly succeed one another in the flow direction.

Manufacturing with electroplating technology and three-dimensional lithography yields particular advantages in terms of contouring, some of which are listed in brief and summary fashion below:

Layers have a constant thickness over the disk surface;

Because of the three-dimensional lithographic patterning, creation of vertical orifices in the layers to form the respective cavities through which flow occurs (deviations of approx. 3° from optimally vertical walls may occur for production-related reasons);

Intentional undercuts and overlaps in the orifices can be produced by building up multiple plies of individually patterned metal layers;

Orifices can have any desired cross-sectional shape with essentially axially parallel walls;

The swirl disk is of integral configuration, since the individual metal deposits are produced directly onto one another.

A characteristic of the method of successive application of photolithographic steps (UV three-dimensional lithography) and subsequent microelectroplating is that it guarantees high-precision patterns even over a large area, so that it is ideally usable for mass production with very large unit volumes (excellent batch capability). A plurality of swirl disks 30 can be fabricated simultaneously on one panel or wafer.

Figure 2:
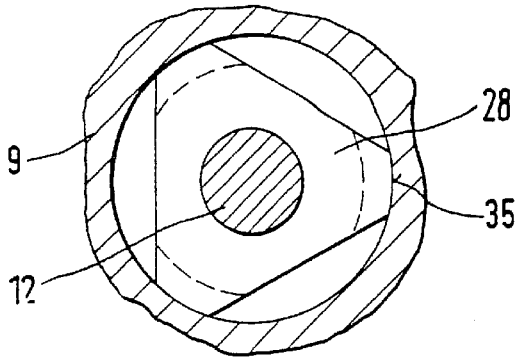
FIG. 2 shows a section along line II—II of FIG. 1.

FIG. 2 shows a section, along line II—II in FIG. 1, through valve needle 12, looking toward a guide element 28 that serves not only to guide the axially movable valve needle 12 but also as a locking means for the entire installation complex in passthrough opening 10. While, for example, a first guide function for the axially movable valve part is provided using armature 11, a second lower guide function is ensured in an inner guide opening 29 of guide element 28. Guide element 28 is configured, for example, in the form of a triangle, the three edge regions possessing a certain planar extension and thus constituting three slightly convex locking surfaces 35.

FIGS. 3 through 7 depict further exemplary embodiments of the valve ends with swirl disks 30, configured according to the present invention and corresponding in terms of basic configuration to the downstream valve end in FIG. 1. In the exemplary embodiments of the Figures that follow, parts that remain identical or function identically in terms of the exemplary embodiment depicted in FIG. 1 are labeled with the same reference characters and are not explained further. Attention will be drawn hereinafter only to differences and particular features.

Figure 3:
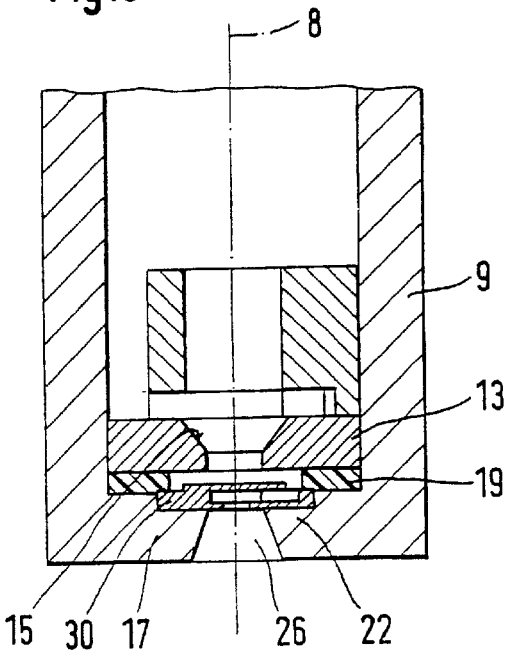
FIG. 3 shows a second exemplary embodiment of a downstream valve end according to the present invention.

The exemplary embodiment depicted in FIG. 3 shows that support element 20 can also be dispensed with. Swirl disk 30 thus rests directly with its lower layer on lower shoulder 22 of base region 17. Outlet opening 26 now represents the downstream end of passthrough opening 10 in base region 17, which either extends concentrically with respect to longitudinal valve axis 8 with a vertical wall or with a wall that expands downstream in conical fashion (FIG. 3), or runs in obliquely inclined fashion with respect to longitudinal valve axis 8, as shown in FIG. 1.

Figure 4:
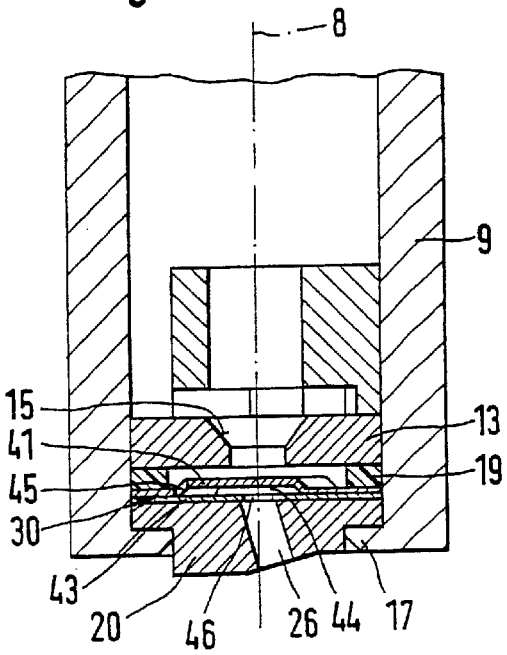
FIG. 4 shows a third exemplary embodiment of a downstream valve end according to the present invention.
Figure 5:
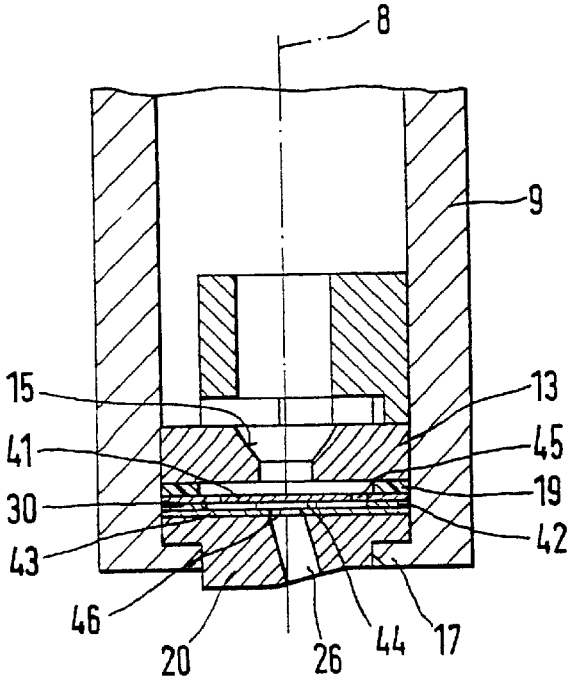
FIG. 5 shows a fourth exemplary embodiment of a downstream valve end according to the present invention.

FIGS. 4 and 5 show two embodiments of atomizer disks in the form of swirl disks 30 that are not manufactured using multilayer electroplating. Swirl disks 30 are constituted by at least two sheet-metal plies 41, 42, 43 stacked onto one another, so that the term "metal laminate disk" can be used. These swirl disks 30 are configured, for example, with an outside diameter such that they rest with a large surface area on support element 20, and so that the disk-shaped sealing element 19 can act in the outer rim region of swirl disks 30 between valve seat element 13 and swirl disk 30. Processes such as electrodischarge machining, punching, stamping, or etching are used in the manufacture of sheet-metal plies 41, 42, 43. The individual sheet-metal plies are attached to one another by, for example, stamping, crimping, laser adhesion, laser welding, diffusion soldering, brazing, or adhesive bonding to form metal laminate atomizer disks.

In the example depicted in FIG. 4, a two-layer swirl disk 30 is provided; in a central disk region, an upper sheet-metal ply 41 facing toward valve seat 15 is spaced away from lower sheet-metal ply 43. The gap formed in the central disk region between the two sheet-metal plies 41, 43 forms a swirl chamber 44 that is filled through multiple inflow openings 45 introduced into the upper sheet-metal ply. The fuel, to which a swirl is imparted, emerges from swirl disk 30 through an outlet opening 46 configured in lower sheet-metal ply 43, and immediately thereafter enters into outlet opening 26 of support element 20 or of base region 17 of valve seat support 9.

FIG. 5 depicts a valve end in which a three-ply swirl disk 30 is provided. A further sheet-metal ply 42 is introduced between upper sheet-metal ply 41 and lower sheet-metal ply 43. Whereas multiple inflow openings 45 are provided in upper sheet-metal ply 41, and one outlet opening 46 is provided in lower sheet-metal ply 43, middle sheet-metal ply 42 has an opening structure that comprises swirl channels and a swirl chamber 44. In order to impart swirl to the fuel, the swirl channels open tangentially into swirl chamber 44.

In particularly advantageous fashion, support element 20 or valve seat support 9 is equipped with an outlet opening 26 with which direct flow influence can be exerted on the swirled fuel emerging from swirl disk 30. Spray shaping is thus additionally performed in very simple fashion after swirling. The static flow volume and the spray parameters affecting the spray angle are established, separately from one another, by way of the geometrical arrangement. The static flow volume is established using swirl disk 30, while the spray angles of the spray (both the opening angle of the actual spray and, in the case of oblique spray discharge, the spray angle y with respect to longitudinal valve axis 8) are established with outlet opening 26 downstream from swirl disk 30.

Figure 6:
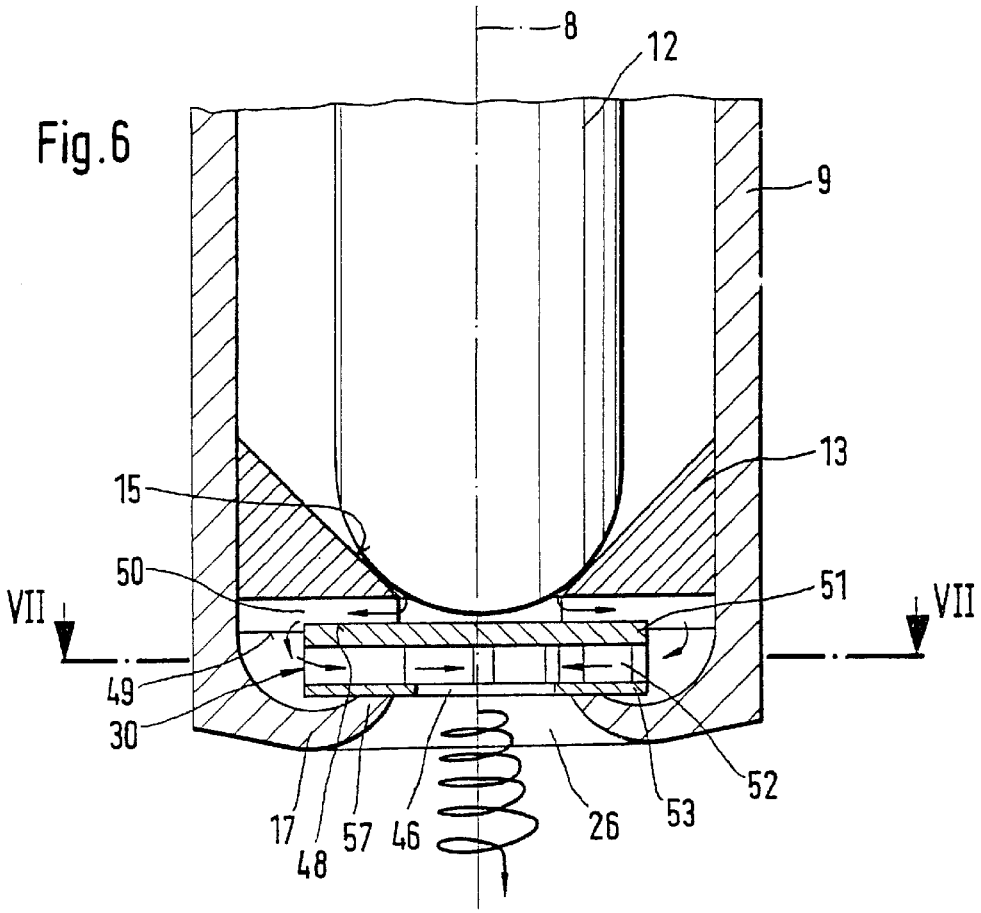
FIG. 6 shows a fifth exemplary embodiment of a downstream valve end according to the present invention.
Figure 7:
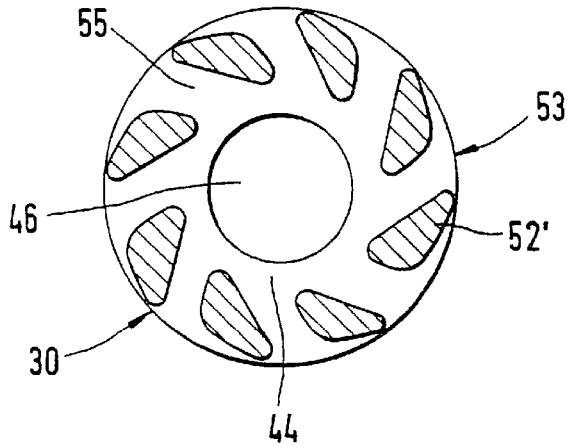
FIG. 7 shows a section along line VII—VII in FIG. 6.

FIGS. 6 and 7 show a further example of a valve end, FIG. 7 being a section along line VII—VII in FIG. 6. The valve end in FIG. 6 is shown in only simplified fashion and is intended merely to illustrate the general installation concept, which corresponds to that of all the exemplary embodiments described previously. Here again, swirl disk 30 and valve seat element 13 are introduced into valve seat support 9 from the inflow direction, since lower base region 17, because of its transverse extension, does not permit installation of these valve parts from the spray-discharge side.

In the example shown in FIG. 6, valve seat support 9 is embodied without steps. Instead, base region 17 is bent over in the form of an annular collar. Valve seat element 13 possesses on its lower end surface 49 several radially extending grooves 50 which extend in a star shape and result in radial propagation of the fuel. Provided in the center region of end face 49 is a slight depression 48 into which swirl disk 30 is inserted in centered and dimensionally accurate fashion. Upon installation of valve seat element 13 and swirl disk 30, the two components are joined to one another. To facilitate assembly, swirl disk 30 can also be held on valve seat element 13 using a suction tool acting from the side facing away from base region 17. Swirl disk 30 ultimately comes to rest against an inner annular end region 57 of base region 17 that is configured, for example, in a hook shape.

Because of the axial fitting pressure upon insertion of valve seat element 13, swirl disk 30 is pressed slightly into the raised end region 57. The sealing of swirl disk 30 that can thus be achieved is sufficient that additional sealing elements can be dispensed with. The fact that swirl disk 30 rests on end region 57 of valve seat support 9 well inside its outer circumference reduces the risk that swirl disk 30 will deflect when a high fuel pressure is applied. A pressure-tight join between valve seat element 13 and valve seat support 9 is achieved, for example, by the fact that an adhesive, for example a capillary Loctite adhesive, is introduced into the contact region between the two components over the periphery. As an alternative to this, a circumferential weld bead can also be applied.

Swirl disk 30 has, for example, three layers 51, 52, 53 manufactured by multilayer electroplating and deposited one onto another. Upper layer 51 is a cover layer with no opening structures, which thus completely covers swirl chamber 44 located beneath it and allows radial flow outward through grooves 50. Middle layer 52 is configured as a swirl creation layer, in which are provided multiple material regions 52', spaced apart from one another, that determine by way of their contours the dimensions of inner swirl chamber 44 and of swirl channels 55 opening into it. Fuel enters swirl channels 55 from the outside and then flows through them toward swirl chamber 44. Material regions 52' are, for example, droplet-shaped, blade-like, strut-shaped, or helical. Lower layer 53 possesses only outlet opening 46, from which the fuel passes immediately into outlet opening 26 of valve seat support 9.

In addition to the swirl disks 30, of which only a few of very many possible variant configurations are depicted in FIG. 7, it is also possible to use other embodiments of multiple-ply or multilayer atomizer disks, for example disks that exhibit an offset between inlet and outlet and thus generate a so-called S-curve, and can be fabricated from metal as multilayer electroplated disks or metal laminate disks.

What is claimed is:

1. A fuel injection valve for a fuel injection system of an internal combustion engine, comprising:

a movable valve part;

an actuator for actuating the movable valve part;

a fixed valve seat configured on a valve seat element, the movable valve part coacting with the valve seat to open and close the fuel injection valve;

a multilayer atomizer disk arranged downstream from the valve seat; and a valve support seat having a passthrough opening extending along a longitudinal axis of the fuel injection valve, the valve seat element and the atomizer disk being positioned in the passthrough opening, the valve seat support being configured so that the valve seat element and the atomizer disk can be installed into the passthrough opening only from the inflow direction, wherein the valve seat element has an outlet, and wherein the multilayer atomizer disk has an inlet opening that is offset radially and outwardly from the outlet of the valve seat element.

2. The fuel injection valve according to claim 1, wherein the fuel injection valve is for directly injecting field into a combustion chamber of the internal combustion chamber.

3. The fuel injection valve according to claim 1, wherein the atomizer disk is configured as a swirl disk having a swirl chamber and at least two swirl channels opening to the swirl chamber.

4. The fuel injection valve according to claim 1, wherein the atomizer disk includes a plurality of layers built up onto one another directly in permanently adhering fashion by electroplating deposition.

5. The fuel injection valve according to claim 1, wherein the atomizer disk includes at least two sheet-metal plies build up onto one another.

6. The fuel injection valve according to claim 1, wherein the valve seat support includes a lower base region in which an opening cross section of the passthrough opening is reduced as compared to an opening cross section of the passthrough opening in a region of the valve seat element.

7. The fuel injection valve according to claim 6, wherein the lower base region has stepped configuration with at least one shoulder in an area of the reduced opening cross section of the passthrough opening.

8. The fuel injection valve according to claim 6, wherein the base region is configured in a form of an annular collar.

9. The fuel injection valve according to claim 6, wherein the atomizer disk rests at least partially on the base region.

10. The fuel injection valve according to claim 6, further comprising:

a support element which projects through the passthrough opening in the base region, the support element having an upper end face upon which the atomizer disk rests, the support element being provided downstream from the atomizer disk.

11. The fuel injection valve according to claim 1, further comprising:

a sealing element positioned between the valve seat element and the atomizer disk.

12. The fuel injection calve according to claim 1, wherein an outlet opening is provided in the fuel injection valve, the outlet opening extending one of i) parallel to the longitudinal axis, and ii) obliquely inclined at a predetermined angle to the longitudinal axis, the outlet opening being provided downstream from the atomizer disk.

13. The fuel injection valve according to claim 1, wherein surface of the atomizer disk directly facing the movable valve part has no opening.

14. The fuel injection valve according to claim 1, wherein the multilayer atomizer disk has openings in each of the layers.

15. The fuel injection valve according to claim 1, wherein the multilayer atomizer disk has openings in each of the layers and wherein the center of openings in at least two layers are offset from each other.

16. The fuel injection valve according to claim 1, wherein the atomizer disk has a swirl chamber.

17. A method of assembling a fuel injection valve for a fuel injection system of an internal combustion engine, comprising:

providing a valve part, the valve part being axially movable along a longitudinal axis of the fuel injection valve;

providing a fixed valve seat, the valve part coacting with the valve seat to open and close the fuel injection valve;

providing an actuator for actuating the movable valve part;

providing a valve seat element on which the valve seat is shaped;

providing a multilayer atomizer disk;

providing a valve seat support having a passthrough opening, the passthrough opening extending along the longitudinal axis;

introducing the atomizer disk and the valve seat element into the passthrough opening of the valve seat support only from an inflow direction, the atomizer disk being arranged downstream from the valve seat, the valve seat support being configured so that the atomizer disk and the valve seat element can be installed into the passthrough opening only from the inflow direction;

immobilizing the atomizer disk and the valve seat element in the passthrough opening, wherein the valve seat element has an outlet, and wherein the multilayer atomizer disk has an inlet opening that is offset radially and outwardly from the outlet of the valve seat element.

18. The method according to claim 17, wherein the fuel injection valve directly injects fuel into a combustion chamber of the internal combustion engine.

19. The method according to claim 17, further comprising:

introducing a sealing element between the atomizer disk and the valve seat element.

20. The method according to claim 17, wherein surface of the atomizer disk directly facing the movable valve part has no opening.

21. The method according to claim 17, wherein the multilayer atomizer disk has openings in each of the layers.

22. The method according to claim 17, wherein the multilayer atomizer disk has openings in each of the layers and wherein the center of openings in at least two layers are offset from each other.

23. The method according to claim 17, wherein the atomizer disk is provided with a swirl chamber.

24. A method of assembling a fuel injection valve for a fuel injection system of an internal combustion engine, comprising:

providing a valve part, the valve part being axially movable along a longitudinal axis of the fuel injection valve;

providing a fixed valve seat, the valve part coacting with the valve seat to open and close the fuel injection valve;

providing an actuator for actuating the movable valve part;

providing a valve seat element on which the valve seat is shaped;

providing a multilayer atomizer disk;

providing a valve seat support having a passthrough opening, the passthrough opening extending along the longitudinal axis;

introducing the atomizer disk and the valve seat element into the passthrough opening of the valve seat support only from an inflow direction, the atomizer disk being arranged downstream from the valve seat, the valve seat support being configured so that the atomizer disk and the valve seat element can be installed into the passthrough opening only from the inflow direction;

immobilizing the atomizer disk and the valve seat element in the passthrough opening, and further comprising;

introducing a support element into the passthrough opening in front of the atomizer disk and the valve seat element, the support element being introduced only from the inflow direction.

25. A fuel injection valve for a fuel injection system of an internal combustion engine, comprising:

a movable valve part;

an actuator actuating the movable valve part;

a fixed valve seat configured on a valve seat element, the movable valve part coacting with the valve seat to open and close the fuel injection valve;

a multilayer atomizer disk arranged downstream from the valve seat; and a valve seat support having a passthrough opening extending along a longitudinal axis of the fuel injection valve, the valve seat element and the atomizer disk being positioned in the passthrough opening, the valve seat support being configured so that the valve seat element and the atomizer disk can be installed into the passthrough opening only from an inflow direction, and wherein the surface of the multilayer atomizer disk facing the movable valve part is a cover layer with no open structure and wherein the multilayer atomizer disk has an opening from an edge area of the multilayer atomizer disk.

26. A method of assembling a fuel injection valve for a fuel injection system of an internal combustion engine, comprising:

providing a valve part, the valve part being axially movable along a longitudinal axis of the fuel injection valve;

providing a fixed valve seat, the valve part coacting with the valve seat to open and close the fuel injection valve;

providing an actuator for actuating the movable valve part;

providing a valve seat element on which the valve seat is shaped;

providing a multilayer atomizer disk, wherein the surface of the multilayer atomizer disk facing the valve part is a cover layer with no open structure and wherein the multilayer atomizer disk has an opening from an edge area of the multilayer atomizer disk;

providing a valve seat support having a passthrough opening, the passthrough opening extending along the longitudinal axis;

introducing the atomizer disk and the valve element into the passthrough opening of the valve seat support only from an inflow direction, the atomizer disk being arranged downstream from the valve seat, the valve seat support being configured so that the atomizer disk and the valve seat element can be installed into the passthrough opening only from the inflow direction; and immobilizing the atomizer disk and the valve seat element in the passthrough opening.

* * * * *

UNITED STATES PATENT AND TRADEMARK OFFICE

CERTIFICATE OF CORRECTION

PATENT NO. : 6,405,935 B2
DATED : June 18, 2002
INVENTOR(S) : Günter Dantes et al.

It is certified that error appears in the above-identified patent and that said Letters Patent is hereby corrected as shown below:

Title page,
Item [57], ABSTRACT, change "Fuel injection valve" to -- A fuel injection valve --

Column 8,
Line 52, change "calve" to -- valve --

Signed and Sealed this

Eleventh Day of May, 2004

JON W. DUDAS
*Acting Director of the United States Patent and Trademark Office*